US006617833B1

(12) United States Patent
Xi

(10) Patent No.: US 6,617,833 B1
(45) Date of Patent: Sep. 9, 2003

(54) SELF-INITIALIZED SOFT START FOR MILLER COMPENSATED REGULATORS

(75) Inventor: Xiaoyu Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/113,270

(22) Filed: Apr. 1, 2002

(51) Int. Cl.[7] ..... G05F 1/40
(52) U.S. Cl. ..... 323/282; 323/280
(58) Field of Search ..... 323/273, 280, 323/281, 282, 315, 351; 327/538

(56) References Cited

U.S. PATENT DOCUMENTS

| | | | | | |
|---|---|---|---|---|---|
| 3,648,154 | A | * | 3/1972 | Frederiksen et al. | 323/313 |
| 4,881,023 | A | * | 11/1989 | Perusse et al. | 323/266 |
| 6,304,131 | B1 | * | 10/2001 | Huggins et al. | 327/538 |
| 6,448,750 | B1 | * | 9/2002 | Shor et al. | 323/282 |
| 6,518,737 | B1 | * | 2/2003 | Stanescu et al. | 323/280 |

* cited by examiner

*Primary Examiner*—Adolf D. Berhane
(74) *Attorney, Agent, or Firm*—J. Dennis Moore; W. James Brady, III; Frederick J. Telecky, Jr.

(57) ABSTRACT

A Miller compensated voltage regulator, adapted to be supplied with power from a voltage supply, and having an input port and an output port. The voltage regulator includes a voltage regulation circuit responsive to a reference voltage at the input port to provide a regulated voltage at the output port. The voltage regulation circuit includes a first amplifier adapted to receive a reference voltage at a first input, having a second input, and having an output, and also a second amplifier having a first input coupled to an internal node, the internal node being coupled to the output of the first amplifier, the second amplifier having a second input adapted to receive a bias voltage and having an output. A pass transistor is provided having a source coupled to the voltage supply, having a drain coupled to the output port, and having a gate coupled to the output of the second amplifier, and a Miller compensation capacitor is provided coupled between the output port and the internal node. A feedback circuit is coupled between the output port and the second input of the first amplifier. In accordance with the invention, an enable control circuit is provided, adapted to maintain the internal node at a high impedance with respect to the voltage supply for a predetermined interval in response to a transition of an enable signal from signaling a disable mode to signaling an enable mode. This allows the voltage at the internal node to rise to the level of the bias voltage, or nearly so, before the voltage at the output port reaches the desired regulated level.

6 Claims, 2 Drawing Sheets

SELF-INITIALIZED SOFT START FOR MILLER COMPENSATED REGULATORS

TECHNICAL FIELD OF THE INVENTION

This invention relates to voltage regulators, and more particularly relates to methods for preventing overshoot in Miller compensated voltage regulators during enable.

BACKGROUND OF THE INVENTION

Electronic circuits are increasingly used in portable and mobile applications in which low power consumption is highly desirable in order to avoid the necessity of large and bulky battery supplies. Such applications include wireless phones, personal pagers, personal digital assistants, etc.

One way of achieving such low power consumption is to provide a so-called Disable, or, Power Down, mode for the electronic circuit. Disable mode is provided as a general matter by including a module that monitors the use of the circuit and that signals the circuit to change from a normal mode to a disable mode when the circuit has not been called upon for use after a predetermined time period. This is frequently done by deactivating an enable signal for the circuit. In response, the circuit changes to a disabled state so that it consumes zero or the minimum power possible. When the module detects that the circuit is required for use again, the module signals the circuit to return to normal mode by reactivating the enable signal.

One circuit that finds frequent use in such applications is the Miller compensated voltage regulator. Such voltage regulators are considered desirable due to their flexible requirement regarding external filter capacitors. However, a problem arises in such regulators during the transition from disabled mode to enabled mode. This can be understood by reference to FIG. 1, which shows a circuit diagram of a prior art Miller compensated voltage regulator with enable/disable capability. Briefly, in the circuit of FIG. 1, an input differential pair of PMOS transistors MP1 and MP2 has current provided to their sources by current source 12 sourcing current $I_{TAIL}$. Their drains are connected to a current mirror comprising NMOS transistors MN1 and MN2. A voltage reference $V_{REF}$, such as a bandgap voltage, is provided to the gate of transistor MP2, while a feedback voltage $V_{FB}$ developed at the connection node FB of resistors R1 and R2, connected in series between the output node and ground, is provided to the gate of transistor MP1. The resulting voltage at the connection node between the drain of transistor MP2 and MN2, node $N_{CC}$, is provided to the non-inverting input of an amplifier A2, which has a bias voltage $V_{BIAS}$ provided to its inverting input to control the magnitude of the output voltage $V_{OUT}$ at the output node OUT. The output of amplifier A2 controls the gate of a pass PMOS transistor MP3 connected between the power supply $V_{DD}$ and the output node. A filter capacitor $C_F$, with its equivalent series resistance $R_F$, is connected in parallel with a load, between the output node and ground. Miller compensation is provided by compensation capacitor $C_C$ connected between node OUT and node $N_{CC}$.

Control of standby versus normal mode is provided by NMOS transistor MN3 connected by its source and drain between the source and drain, respectively, of transistor MN1, NMOS transistor MN4 connected by its source and drain between the source and drain, respectively, of transistor MN2, and by PMOS transistor MP4 connected by its source and drain between the source and gate, respectively, of transistor MP3. The inverse of the enable signal, $\overline{ENB}$, is provided to the gate of transistors MN3 and MN4, while the enable signal, ENB, is provided to the gate of transistor MP4. When ENB is low, and thus $\overline{ENB}$ is high, the circuit is disabled. In this state, transistor MN3 turns off transistors MN1 and MN2 by shorting their gates to ground, transistor MN4 pulls node $N_{CC}$ to ground, and transistor MP4 turns off transistor MP3 and amplifier A2. Thus, the regulator circuit consumes, essentially, zero current. In addition, both nodes OUT and FB are grounded by resistors R1 and R2.

During the transition from disable to enable, when ENB is being brought high and $\overline{ENB}$ is being brought low, transistors MN3, MN4 and MP4 are all being turned off, and amplifier A2 is being enabled. Due to the fact that the gate of transistor MP1 is already grounded by node $V_{FB}$, all of the current $I_{TAIL}$ flows through transistors MP1 and MN1. Since transistors MN1 and MN2 are connected as a current mirror, this current through transistor MN1 is mirrored into transistor MN2, causing node $N_{CC}$ to be fully discharged by the current $I_{MN2}$ through transistor MN2. As this occurs, amplifier A2 is overdriven and turns the pass device MP3 fully on, which pumps current $I_{CF}$ into the filter capacitor $C_F$, as well as current $I_{CC}$ into compensation capacitor $C_C$. The current $I_{CF}$ through $C_F$ determines the slew rate of the regulator output $V_{OUT}$. The discharging current $I_{MN2}$, along with capacitor $C_C$, determines the slew rate of node $N_{CC}$. Given the fact that $V_{OUT}$ is ramping up, $N_{CC}$ still ramps up, but at a slower slope due to the discharging current $I_{MN2}$. Depending on the difference between these two rates, if by the time $V_{OUT}$ reaches the desired output level, $V_{REG}$, but the voltage $V_{NCC}$ at node $N_{CC}$ is still lower than $V_{BIAS}$, which means that amplifier A2 is still overdriven at the negative input, then $V_{OUT}$ will still keep rising until $V_{NCC}$ reaches $V_{BIAS}$ and shuts off the pass device transistor MP3. However, by then overshoot has already occurred, and the delay of the circuit response only makes it even worse. As a result, $V_{NCC}$ will go much higher than $V_{BIAS}$, and the regulator will not settle back into its linear region until node OUT is discharged sufficiently so that $V_{OUT}$ has settled to the desired output level $V_{REG}$.

This is shown in FIG. 4, which is a graph of voltage versus time, showing $V_{OUT}$ and $V_{NCC}$, with the transition to enable beginning at time equal zero. As shown, at time t1 $V_{OUT}$ has reached $V_{REG}$, as shown at 41, but $V_{NCC}$, as shown at 42, is still below $V_{BIAS}$. As a result, $V_{OUT}$ continues to rise above $V_{REG}$ until, at time t2 $V_{NCC}$ reaches $V_{BIAS}$, as shown at 43. However, $V_{NCC}$ continues above $V_{BIAS}$, since $V_{OUT}$ is above $V_{REG}$. Eventually, however, both $V_{OUT}$ and $V_{NCC}$ settle toward their steady state voltages, $V_{REG}$ and $V_{BIAS}$, respectively. Throughout the enable process, as described above, the desirable linear slew characteristic of the Miller effect never occurs, because amplifier A2 always saturates in either direction, the root reason being that Node $N_{CC}$ ramps up too slowly relative to node $V_{OUT}$.

It would therefore be desirable to have a Miller compensated voltage regulator with enable/disable capability that avoids the problems described above.

SUMMARY OF THE INVENTION

As a general matter, the invention provides protection against overshoot as described above. This is done by controlling the initialization of an internal connection node of a Miller compensation capacitor so as to ensure that the Miller effect provides a linear slew rate at the output node. The rate of increase of the voltage at the internal node is controlled to as to rise to the level of a bias voltage, or to nearly the level of the bias voltage, before the output node reaches the desired output level.

According the invention there is provided a Miller compensated voltage regulator, adapted to be supplied with power from a voltage supply, and having an input port and an output port. The voltage regulator includes a voltage regulation circuit responsive to a reference voltage at the input port to provide a regulated voltage at the output port. The voltage regulation circuit includes a first amplifier adapted to receive a reference voltage at a first input, having a second input, and having an output, and also a second amplifier having a first input coupled to an internal node, the internal node being coupled to the output of the first amplifier, the second amplifier having a second input adapted to receive a bias voltage and having an output. A pass transistor is provided having a source coupled to the voltage supply, having a drain coupled to the output port, and having a gate coupled to the output of the second amplifier, and a Miller compensation capacitor is provided coupled between the output port and the internal node. A feedback circuit is coupled between the output port and the second input of the first amplifier. In accordance with the invention, an enable control circuit is provided, adapted to maintain the internal node at a high impedance with respect to the voltage supply for a predetermined interval in response to a transition of an enable signal from signaling a disable mode to signaling an enable mode. This allows the voltage at the internal node to rise to the level of the bias voltage, or nearly so, before the voltage at the output port reaches the desired regulated level.

These and other features of the invention will be apparent to those skilled in the art from the following detailed description of the invention, taken together with the accompanying drawings.

DETAILED DESCRIPTION OF THE PREFERRED EMBODIMENT

The numerous innovative teachings of the present invention will be described with particular reference to the presently preferred exemplary embodiment. However, it should be understood that this is only one embodiment of many, which depend upon the particular circuit to which the inventive principles are applied. In general, statements made in the specification of the present application do not necessarily delimit the invention, as set forth in different aspects in the various claims appended hereto. Moreover, some statements may apply to some inventive aspects, but not to others.

As a general matter, in the preferred embodiment of the present invention, overshoot as described above is avoided by controlling the initialization of node $N_{CC}$ so as to ensure that the Miller effect provides a linear slew rate at node $V_{OUT}$, with a slope Of $I_{TAIL}/C_C$. The rate of increase of the voltage at node $N_{CC}$ is controlled to as to rise to the level of $V_{BIAS}$, or to nearly the level of $V_{BIAS}$, before node $V_{OUT}$ reaches the desired output level.

Figure 1:
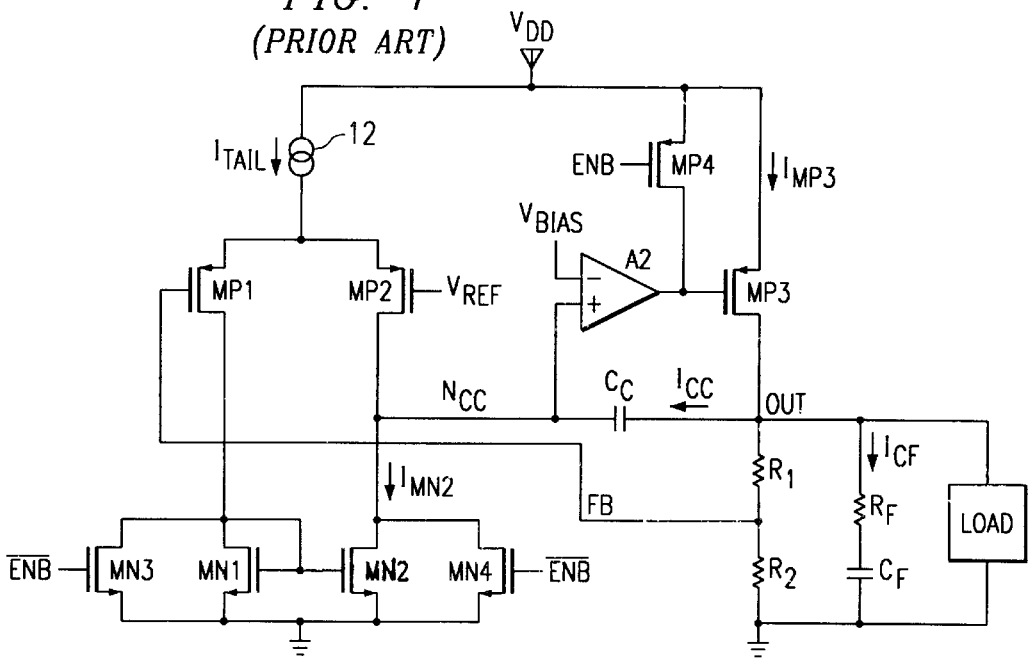
FIG. 1 (PRIOR ART)
FIG. 1 is a circuit diagram of a prior art Miller compensated voltage regulator with enable/disable capability.
Figure 2:
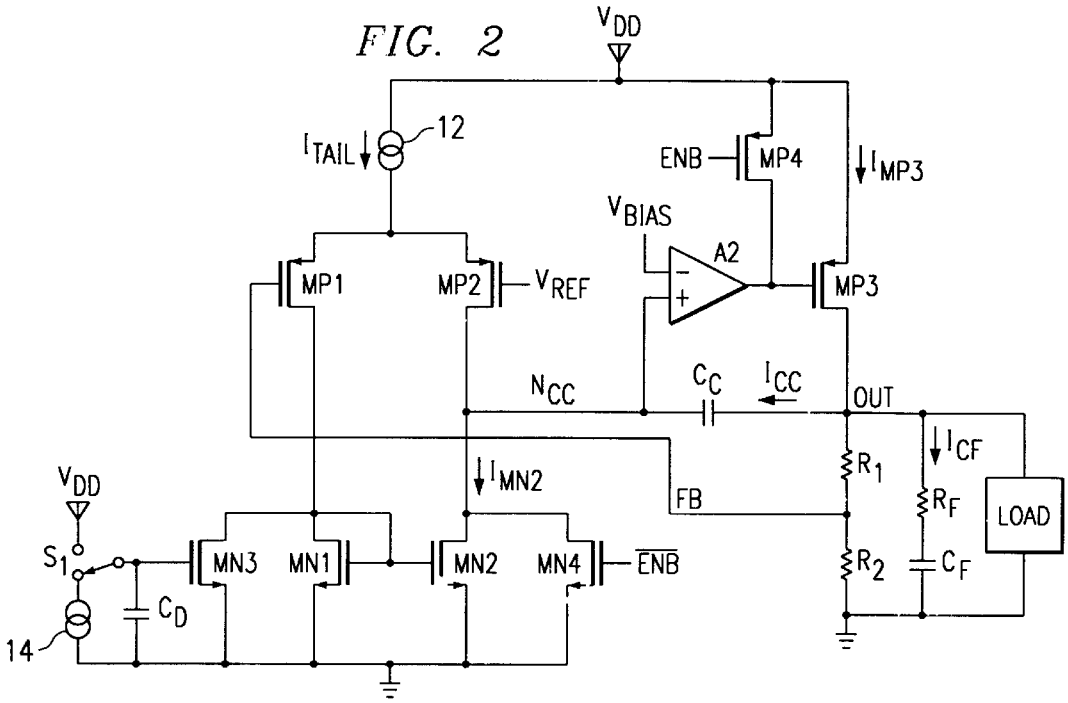
FIG. 2 is a circuit diagram of a Miller compensated voltage regulator modified in accordance with the present invention.

The preferred embodiment of the present invention is shown in FIG. 2. The circuit of FIG. 2 is a Miller compensated voltage regulator like that of FIG. 1, but having added thereto circuitry that provides the inventive solution to the above-described problems. Circuit components that are the same as in FIG. 1 have the same designation as in FIG. 1, and operate the same as described above in the Background section, except as they are influenced by the added circuitry, which is described below. Components in FIG. 2 not found in FIG. 1 are delay capacitor $C_D$ connected between the gate of transistor MN3 and ground, and current sink 14 that sinks current $I_D$, connected between one contact of single pole double throw switch $S_1$, the other contact of switch $S_1$ being connected to $V_{DD}$, with the pole of switch $S_1$ being connected to the gate of transistor MN3.

In the embodiment of FIG. 2, during the transition from disable to enable node $N_{CC}$ is kept at a high impedance for a short interval, by keeping transistor MN2 off. This is accomplished as follows. Switch $S_1$ is controlled by the signal $\overline{ENB}$, being connected to supply $V_{DD}$ when $\overline{ENB}$ is high, i.e., logic "1", and being connected to the current sink 14 when $\overline{ENB}$ is low, i.e., logic "0". When $\overline{ENB}$ is high, switch S1 is connected to $V_{DD}$ and thus the gate of NMOS transistor MN3 is pulled high, which causes the charging of capacitor $C_D$. In the transition from disabled mode to enabled mode, the signal $\overline{ENB}$ goes low, thus switching switch S1 to the current sink 14 sinking $I_D$, which allows current sink to discharge capacitor $C_D$ at a rate determined by the magnitude Of $I_D$ and by the capacitance of capacitor $C_D$. Until capacitor $C_D$ is sufficiently discharged, the turn-on of transistors MN1 and MN2 is prevented. Thus, upon receipt of an enable signal, the turn on of MN2 is delayed by an amount determined by the designer in selecting $I_D$ and $C_D$.

Note that when the signal $\overline{ENB}$ goes low, transistor MP2 is already off at this time due to its gate being biased at $V_{REF}$, which is higher than the voltage at the gate of MP1. As a result, because of the delay of turn on of transistor MN2, node $N_{CC}$ momentarily becomes a high impedance and is pulled up by capacitor $C_C$, following the voltage $V_{OUT}$ at the regulator output OUT. When the voltage $V_{NCC}$ at node $N_{CC}$ reaches the level of $V_{BIAS}$, the amplifier A2 enters into linear region and drives the gate of the pass transistor MP3 to such appropriate level that node $V_{OUT}$ stays flat and MP3 only supplies the current to the resistor string R1 and R2. Thus, the Miller capacitor loop, comprising amplifier A2, transistor MP3 and capacitor $C_C$, is initialized in the linear region, and remains stable throughout the enable process. When capacitor $C_D$ is sufficiently discharged and thus transistor MN2 is allowed to turn on, transistor MN2 sinks a level of current corresponding to the $I_{TAIL}$ level of current from the compensation capacitor $C_C$, and triggers the Miller capacitor loop to react. By this time, the active Miller loop operates like an integrator, and ensures that node $V_{OUT}$ ramps up at a slope of $I_{TAIL}/C_C$ while node $N_{CC}$ stays in the vicinity of $V_{BIAS}$.

Figure 3:
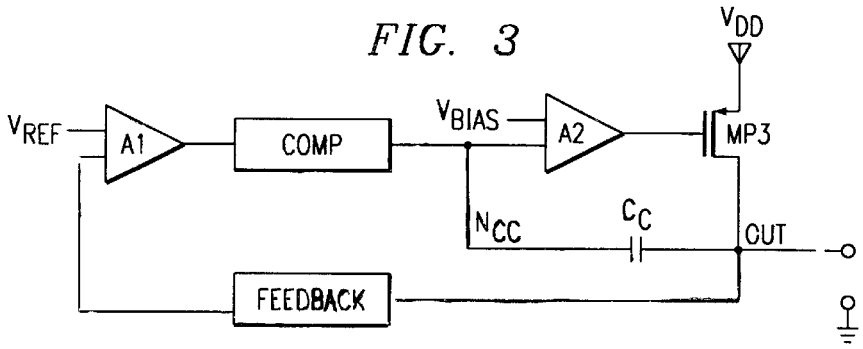
Figure 4:
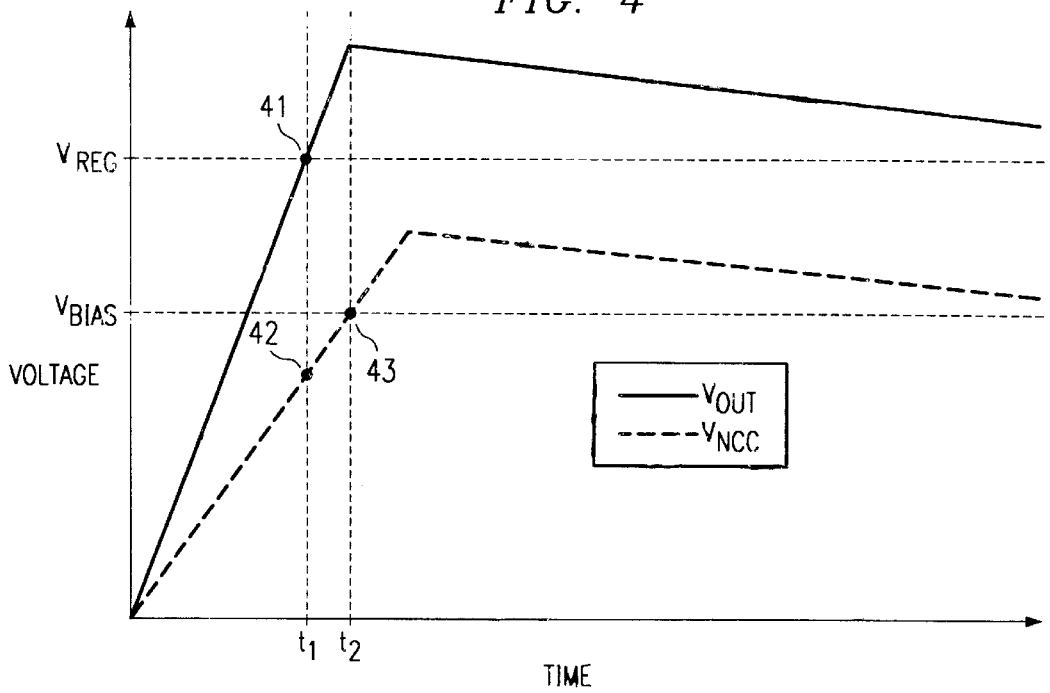

Although the present invention and its advantages have been described in detail, it should be understood that various changes, substitutions and alterations can be made herein without departing from the spirit and scope of the invention as defined by the appended claims. Thus, it will be readily understood by those of ordinary skill in the art to which the invention pertains that the inventive principles can be applied to many other Miller compensated circuit arrangements to avoid output overshoot on transition to enable mode. In general, the type of Miller compensated circuit arrangement to which the invention may be applied is shown in FIG. 3, with the inventive addition being the provision of means, represented in block COMP, for maintaining node $N_{CC}$ at a high impedance for a predetermined time during the transition from disable mode to enable mode, to allow the voltage at node $N_{CC}$ to rise to $V_{BIAS}$, or nearly $V_{BIAS}$ before the voltage at node OUT reaches the desired level.

What is claimed is:

1. A Miller compensated voltage regulator, adapted to be supplied with power from a voltage supply, and having an input port and an output port, comprising:

a voltage regulation circuit responsive to a reference voltage at the input port to provide a regulated voltage at the output port, comprising a first amplifier adapted to receive a reference voltage at a first input, having a second input, and having an output, a second amplifier having a first input coupled to an internal node, said internal node being coupled to the output of said first amplifier, said second amplifier having a second input adapted to receive a bias voltage and having an output, a pass transistor having a source coupled to the voltage supply, having a drain coupled to the output port, and having a gate coupled to the output of said second amplifier, a Miller compensation capacitor coupled between the output port and said internal node, a feedback circuit coupled between the output port and the second input of said first amplifier; and an enable control circuit adapted to maintain said internal node at a high impedance with respect to the voltage supply for a predetermined interval in response to a transition of an enable signal from signaling a disable mode to signaling an enable mode.

2. A Miller compensated voltage regulator, adapted to be supplied with power from a voltage supply, and having an input port and an output port, comprising:

a voltage regulation circuit responsive to a reference voltage at the input port to provide a regulated voltage at the output port, comprising a current source adapted to be coupled to the voltage supply for supplying a predetermined current, a first input transistor and a second input transistor connected together as a differential pair to receive said predetermined current, said first input transistor having a gate for receiving an input reference voltage, said first input transistor and said second input transistor being connected to controlling circuitry for providing a regulated voltage at the output port, a current mirror comprising a first current mirror transistor connected between said first input transistor and a ground and a second current mirror transistor connected between said second input transistor and said ground, and a Miller compensation capacitor connected between the output port and an internal node comprising the common connection node of said first input transistor and said first current mirror transistor; and an enable control circuit, comprising an enable circuit responsive to an enable signal signaling a disable mode to prevent said current mirror from conducting current, and responsive to said enable signal signaling an enable mode to allow said current mirror to conduct current, and a delay circuit responsive to a transition in said enable signal from signaling said disable mode to signaling said enable mode, for maintaining said internal node at a high impedance with respect to the voltage supply for a predetermined interval.

3. A Miller compensated voltage regulator in accordance with claim 2, wherein said first and second input transistors are PMOS transistors connected together and connected to said current source at their source nodes;

said first and second current mirror transistors are NMOS transistors; and the drain of said first input transistor is connected to the drain of said first current mirror transistor, and the drain of said second input transistor is connected to the drain of said second current mirror transistor.

4. A Miller compensated voltage regulator in accordance with claim 3, further comprising a first resistor and a second resistor connected in series between the output port and said ground, wherein the common connection node of said first and second resistors is connected to the gate of said second input transistor.

5. A Miller compensated voltage regulator in accordance with claim 4, wherein said circuitry for providing a regulated voltage further comprises:

a PMOS pass transistor connected by its source and drain between the voltage supply and the output port; and an amplifier having an inverting and a non-inverting input and having an output, said non-inverting input being coupled to said common node to said first input transistor and said first current mirror transistor, said inverting input being adapted to receive a bias voltage, and said output of said amplifier being coupled to the gate of said pass transistor.

6. A Miller compensated voltage regulator according to claim 5:

wherein said enable circuit comprises a first enable NMOS transistor having its drain coupled to the drain of said first current mirror transistor, and having its gate adapted to receive an inverted enable signal, and a second enable NMOS transistor having its drain coupled to the drain of said second current mirror transistor; and wherein said delay circuit comprises a discharge capacitor coupled between the gate of said second enable NMOS transistor and said ground, and a current source adapted to be connected between the plates of said discharge capacitor in response to said enable signal signaling said enable mode, and to be disconnected from said plates of said discharge capacitor in response to said enable signal signaling said disable mode, wherein the voltage supply is connected to the gate of said second enable NMOS transistor when said enable signal signals said disable mode.

* * * * *